US008670005B2

(12) United States Patent
Lei

(10) Patent No.: US 8,670,005 B2
(45) Date of Patent: Mar. 11, 2014

(54) METHOD AND SYSTEM FOR REDUCING DYNAMIC FALSE CONTOUR IN THE IMAGE OF AN ALTERNATING CURRENT PLASMA DISPLAY

(75) Inventor: Weilin Lei, Beijing (CN)

(73) Assignee: Sichuan COC Display Devices Co., Ltd., Sichuan Province (CN)

( * ) Notice: Subject to any disclaimer, the term of this patent is extended or adjusted under 35 U.S.C. 154(b) by 744 days.

(21) Appl. No.: 12/744,298

(22) PCT Filed: Nov. 21, 2008

(86) PCT No.: PCT/CN2008/073154

§ 371 (c)(1),
(2), (4) Date: May 21, 2010

(87) PCT Pub. No.: WO2009/074054

PCT Pub. Date: Jun. 18, 2009

(65) Prior Publication Data

US 2010/0259567 A1 Oct. 14, 2010

(30) Foreign Application Priority Data

Nov. 23, 2007 (CN) ..... 2007 1 019456

(51) Int. Cl.
*G09G 5/10* (2006.01)

(52) U.S. Cl.
USPC ..... 345/690; 345/60; 315/169.1

(58) Field of Classification Search
USPC ..... 345/60–68, 88–89, 690–693; 315/169.1–169.4
See application file for complete search history.

(56) References Cited

U.S. PATENT DOCUMENTS

| | | | | |
|---|---|---|---|---|
| 6,396,508 | B1 * | 5/2002 | Noecker | 345/693 |
| 6,424,325 | B1 * | 7/2002 | Van Dijk | 345/60 |
| 7,675,483 | B2 | 3/2010 | Okuzawa | |
| 8,199,831 | B2 * | 6/2012 | Correa et al. | 375/240.26 |
| 2002/0027535 | A1 * | 3/2002 | Van Dijk | 345/60 |
| 2005/0083263 | A1 | 4/2005 | Park | |
| 2007/0075928 | A1 * | 4/2007 | Takeuchi et al. | 345/63 |
| 2007/0165051 | A1 * | 7/2007 | Yamada | 345/690 |
| 2007/0171241 | A1 * | 7/2007 | Kimura | 345/690 |
| 2008/0278416 | A1 * | 11/2008 | Ohta et al. | 345/63 |

FOREIGN PATENT DOCUMENTS

| | | |
|---|---|---|
| CN | 1246951 | 3/2000 |
| CN | 1609933 | 4/2005 |
| CN | 1801292 | 7/2006 |
| CN | 1950868 | 4/2007 |

(Continued)

OTHER PUBLICATIONS

Korean Office Action for 10-2010-7013802, dated Oct. 27, 2011.

(Continued)

*Primary Examiner* — Kimnhung Nguyen
(74) *Attorney, Agent, or Firm* — Greenberg Traurig, LLP

(57) ABSTRACT

The present invention discloses a method for and a system for reducing the dynamic false contour in the image of an alternating current plasma display. The method includes the following steps: dividing each frame image into multiple subfields; accounting the number and the probability of the dynamic false contour appeared in each frame image; based on the result of the accounting, carrying out an optimized coding for the pixel data of each frame image, and if there is an error generated by the optimized coding, diffusing the error generated by the optimized coding into neighboring pixels.

6 Claims, 6 Drawing Sheets

(56) References Cited

FOREIGN PATENT DOCUMENTS

| | | | |
|---|---|---|---|
| EP | 1612758 | A2 | 1/2006 |
| EP | 1845509 | A1 | 10/2007 |
| JP | 2000181403 | | 6/2000 |
| KR | 10-0589379 | | 6/2006 |
| KR | 10-2007-0053162 | | 5/2007 |
| WO | WO 2005/057540 | | 6/2005 |

OTHER PUBLICATIONS

Supplementary European Search Report for Application No. EP 08858498, completed on Apr. 24, 2012 in Munich.

* cited by examiner

The curve of change in the result of integral on the grayscale from 127 to 128 by human eyes (dark fringe appears)

METHOD AND SYSTEM FOR REDUCING DYNAMIC FALSE CONTOUR IN THE IMAGE OF AN ALTERNATING CURRENT PLASMA DISPLAY

RELATED APPLICATIONS

This application claims the benefit of and priority to PCT International Application No. PCT/CN2008/073154, filed Nov. 21, 2008, which claims priority to Chinese Patent Application Serial No. 2007/1194561, filed Nov. 23, 2007, the contents of both of which are incorporated by reference herein in their entirety.

FIELD OF THE INVENTION

The present invention relates to the field of display, and in particular to a method for reducing the dynamic contour of an alternating current plasma display.

BACKGROUND OF THE INVENTION

The Alternating Current-Plasma Display (AC-PDP) uses a multi-subfield display technology to realize multiple grayscale levels for displaying an image. Different subfields have different weights (representing that the numbers of sustain pulses of different subfields are different). Multiple grayscales for displaying an image are realized via a combination of the subfields of different weights.

The multi-subfield display technology has a problem of false contour in a moving image. This is due to on one hand, the physiological characteristics of human eyes will move with the movement of an object; and on the other hand, the integral effect of vision. The perception of the human eyes to images and colors is the integral of the colors and brightness within a period of time. Hence, when multiple subfields are used to realize the multiple grayscale levels of an image, for a moving image, a phenomenon will appear that some places of the image are too bright or dark, which disappears once the moving image stops moving. The phenomenon that some places of the image are bright or dark alternatively is called a dynamic false contour phenomenon, which is a problem within the principle of the display technology and will be further discussed below.

Assume that one field of image is divided into eight subfields: SF1, SF2, SF3, SF4, SF5, SF6, SF7 and SF8, and the weights thereof are 1, 2, 4, 8, 16, 32, 64, and 128, respectively. Assume that an image moves from the left to the right, and there are two grayscale levels of 127 and 128 on the moving image. With the above mentioned weights of the subfields, the code for the grayscale level 127 is 11111110, and the code for the grayscale level 128 is 00000001. When the grayscale level is transiting from 127 to 128, the 8th subfield of the display grayscale 127 is not lighted, and the 1st, 2nd, 3rd, 4th, 5th, 6th and 7th subfields of the grayscale 128 are also in an unlighted state. Thus, since the order for displaying the subfields of the grayscale 127 is from the 1st subfield, the 2nd subfield, until the 8th subfield, the subfields following the 8th subfield are all in an unlighted state, and when entering the 1st, 2nd, 3rd, 4th, 5th, 6th and 7th subfields for displaying the grayscale 128, it is still in an unlighted state. Hence, from the 8th subfield of the grayscale 127 to the 7th subfield of the grayscale 128, the integrated grayscale of the human eyes to the image is 0, and thus a dark fringe appears, as shown in FIG. 3. In the same way, when the image is moving from the left to the right, a bright fringe also appears. Such dark fringe and bright fringe are the dynamic false contours.

See from the above principle, the dynamic false contour appears between image frames, different grayscale transitions between adjacent frames are integrated multiple times in the human eyes, if the result of the integral is the brightness perceived by the human eyes within one field of time. As known from FIG. 2, eight subfields are taken as an example, the integral of the human eyes has been made eight times during the transitions between different grayscales of adjacent fields, and each time a grayscale level is perceived, and if the grayscale levels of the eight perceptions greatly deviate from the display grayscale level, the human eyes perceive the dynamic false contour. For example, for the transition from grayscale 127 to grayscale 128, the codes in the order from the 1st subfield to the 8th subfield are 11111110 and 00000001, and the results of eight times of integrals according to the figure are 127, 63, 31, 15, 7, 3, 1, 0 and 128, respectively. During this process, when the result of the integral is 0, due to the severe deviation from the display grayscale level, the human eyes perceive the dynamic false contour. Hence, how to detect the dynamic false contour in an image and take corresponding optimized measures for the coding of the grayscale plays an obvious role for improving the quality of the image.

SUMMARY OF THE INVENTION

The present invention provides a method and a system for reducing the dynamic false contour in the images of an alternating current plasma display, to reduce the false contour in the images of the alternating current plasma display.

The method for reducing the dynamic false contour in the images of an alternating current plasma display according to an embodiment of the presenting invention include the following steps: dividing each frame image into multiple subfields; accounting the number and the probability of the dynamic false contour appeared in each frame image; based on the result of the accounting, carrying out an optimized coding for the pixel data of each frame image, and if there is an error generated by the optimized coding, diffusing the error generated by the optimized coding into neighboring pixels.

Wherein, the optimized coding is carried out for the pixel data of each frame image by the following pixel data optimized coding method: if the maximum subfield with a grayscale data code of 1 is n, the grayscale data codes of the 1st subfield to the nth subfield are all set as 1; if the maximum subfield with a grayscale data code of 1 is n, the grayscale data codes of the subfields among the 1st subfield to the nth subfield are all set as 1 except for the subfields with a grayscale data code of 0; if the maximum subfield with a grayscale data code of 0 or 1 is n, the grayscale data codes of the subfields among the 1st subfield to the nth subfield are all set as 1 except for the subfields with a grayscale data code of 0

Wherein, the subfields with the grayscale data code of 1 are subfields in a lighted state, and the subfields with the grayscale data code of 0 are subfields in an unlighted state.

Wherein, if each frame image does not have a grayscale data code that conforms to a corresponding optimized coding rule, the grayscale level of each frame image is converted in the following manner: the grayscale level=an neighboring grayscale level+a converted grayscale error, and the converted grayscale error is diffused into neighboring pixels.

A system for reducing the dynamic false contour in the image of an alternating current plasma display according to an embodiment of the present invention includes a dynamic false contour detector configured to compare the luminescence mode of one frame image and that of the immediately preceding frame of the image via calculation to detect the false contour of a frame image; and a threshold comparator configured to determine a pixel data optimized coding method for the frame image by comparing a predetermined threshold with the detection result of the dynamic false contour detector so as to optimize the pixel data of the frame image.

Wherein, optimized coding is carried out for the pixel data of the frame image by the following pixel data optimized coding method: if the maximum subfield with a grayscale data code of 1 is n, the grayscale data codes of the 1st subfield to the nth subfield are all set as 1; if the maximum subfield with a grayscale data code of 1 is n, the subfields with a grayscale data code of 0 among the 1st subfield to the nth subfield are all set as 1, or all the subfields are set as 1 except for one subfield code being maintained as 0, wherein the position of the subfield maintained as 0 satisfies the difference between its grayscale value after grayscale code optimization and its grayscale value before the optimization is the minimum; if the maximum subfield with a grayscale data code of 1 is n, the subfields with a grayscale data code of 0 among the 1st subfield to the nth subfield are all set as 1, or all the subfields are set as 1 except for one or two subfield codes being maintained as 0, wherein the position of the subfield maintained as 0 satisfies the difference between its grayscale value after grayscale code optimization and its grayscale value before the optimization is the minimum.

Wherein, the subfields with the grayscale data code of 1 are subfields in a lighted state, and the subfields with the grayscale data code of 0 are subfields in an unlighted state.

The system for reducing image dynamic false contour in an alternating current plasma display according to an embodiment of the present invention further comprising an error diffuser, configured to convert the grayscale level of the frame image in the following manner when the frame image does not have a grayscale data code that conforms to a corresponding pixel data optimized coding method: the grayscale level=a neighboring grayscale level+a converted grayscale error, and the converted grayscale error is diffused into neighboring pixels.

According to the integral generating mechanism of the dynamic false contour, the transition between codes such as 11100000 and 11111100 (the arrangement of the 1st subfield to the 8th subfield) can inhibit the false contour. The present invention inhibits the display of the dynamic false contour by optimizing the coding of the grayscale data of the frame images.

BRIEF DESCRIPTION OF THE ACCOMPANYING DRAWINGS

The accompanying drawings herein are used to provide a further understanding of the present invention and constitute a part of the present application. The illustrative embodiments of the present invention and the description thereof are used to explain the present invention and shall not be construed as limitations on the same. In the accompanying drawings.

DETAILED DESCRIPTION OF THE INVENTION

The embodiments of the present invention will be described in detail in conjunction with the accompanying drawings.

Figure 1:
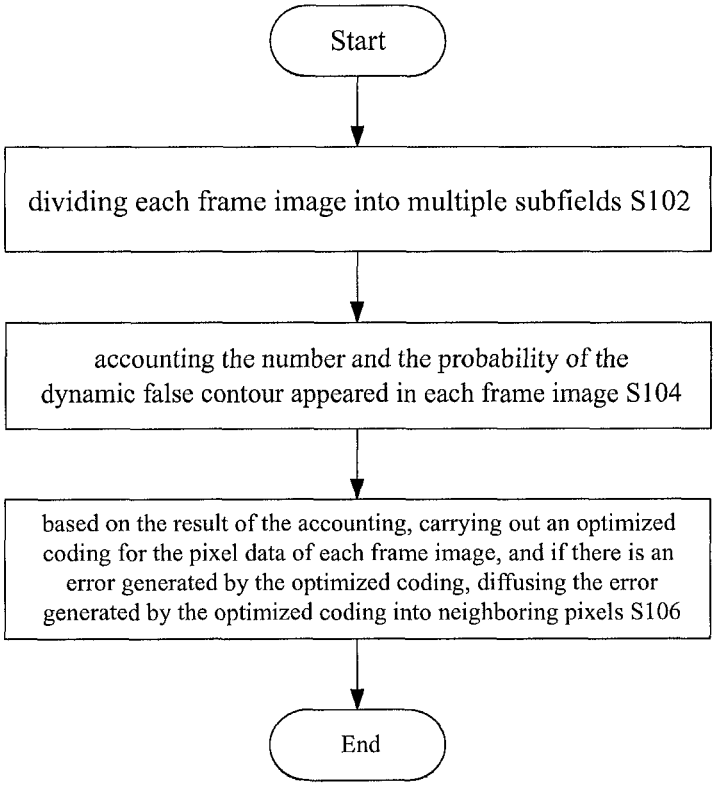
FIG. 1 illustrates the flow of the method for reducing the dynamic false contour in the image of an alternating current plasma display according to an embodiment of the present invention.

Referring to FIG. 1, it is illustrated the method for reducing the dynamic false contour in the image of an alternating current plasma display according to an embodiment of the present invention. As shown in FIG. 1, the method includes the following steps: S102, dividing each frame image into multiple subfields; S104, accounting the number and the probability of the dynamic false contour appeared in each frame image; and S106, based on the result of the accounting, carrying out an optimized coding for the pixel data of each frame image, and if there is an error generated by the optimized coding, diffusing the error generated by the optimized coding into neighboring pixels in case of the error generated by the optimized coding.

Wherein, optimized coding can be carried out for the pixel data of a certain frame image based on the following three pixel data optimized coding methods:

(1) If the maximum subfield with a grayscale data code of 1 is n, the grayscale data codes of the 1st subfield to the nth subfield are all set as 1. That is, all of the 1st digit to the nth digit of the grayscale data code of the certain frame image are 1.

(2) If the maximum subfield with a grayscale data code of 1 is n, the grayscale data codes of the subfields among the 1st subfield to the nth subfield are all set as 1 except for the subfields with a grayscale data code of 0. That is, all of the 1st digit to the nth digit of the grayscale data code of the certain frame image are 1 except for one digit being 0.

(3) If the maximum subfield of the grayscale data code is n, the grayscale data codes of the subfields among the 1st subfield to the nth subfield are all set as 1 except for the subfields with a grayscale data code of 0. That is, all of the 1st digit to the nth digit of the grayscale data code of the certain frame image are 1 except for two digits being 0.

Wherein, the subfields with the grayscale data code of 1 are subfields in a lighted state, and the subfields with the grayscale data code of 0 are subfields in an unlighted state.

Figure 5:
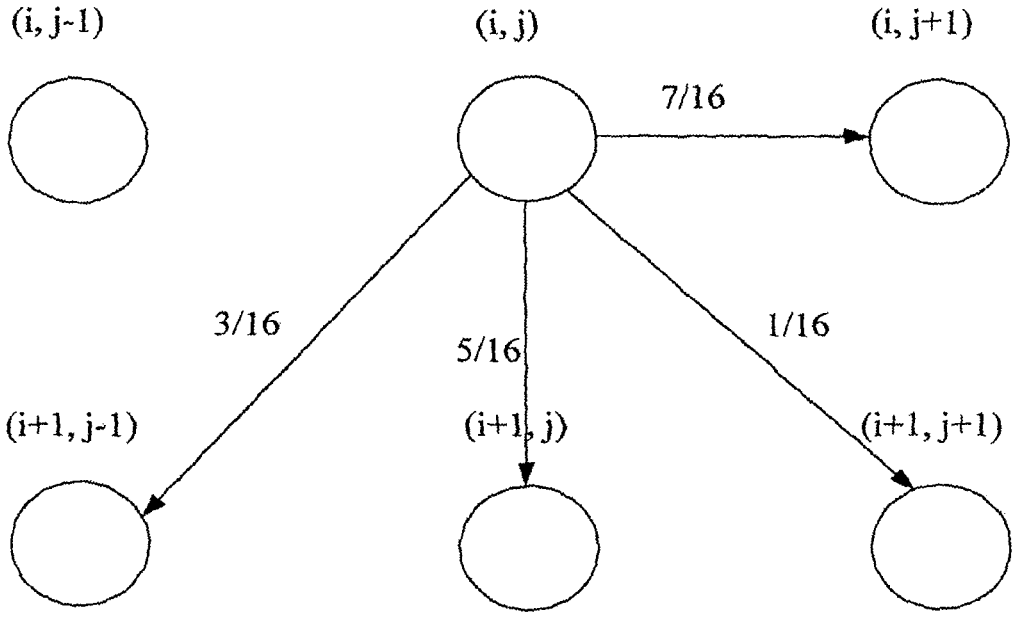
FIG. 5 is a schematic view of the error diffusion according to an embodiment of the present invention.

The method of the pixel data optimized coding method (1) is to select for all possible codes of different grayscale levels according to above coding solution (1). If the grayscale level has a coding manner conforming to the coding solution (1), the coding manner is used as the display code for the grayscale level, and if it does not have, the grayscale level is converted to a neighboring grayscale level code having the coding manner of (1) and the coding manner is the display code, and the conversion manner is: the grayscale level=an neighboring grayscale level+a converted grayscale error. The display grayscale is output, and the converted grayscale error, if any, is diffused in the manner as shown in FIG. 5.

The method of the pixel data optimized coding method (2) is to select for all possible codes of different grayscale levels according to above coding solutions (1) and (2). If the grayscale level has a coding manner conforming to coding solution (1), the coding manner is used as the display code of the grayscale level. On the contrary, it is searched whether any of all the coding manners conforms to coding solution (2). If there is not any code of both of the two solutions of a certain grayscale level, the grayscale level is converted to a neighboring grayscale level code having the above two coding manners and the coding manner is the display code, and the conversion manner is: the grayscale level=a neighboring grayscale level+a converted grayscale error. The display grayscale is output, and the converted grayscale error, if any, is diffused in the manner as shown in FIG. 5.

The method of the pixel data optimized coding method (3) is to select for all possible codes of different grayscale levels according to above coding solutions (1), (2) and (3). If the grayscale level has a coding manner conforming to coding solution (1), the coding manner is used as the display code of the grayscale level. On the contrary, it is searched whether any of all the coding manners conforms to coding solution (2); on the contrary, it is searched whether any of all the coding manners conforms to coding solution (3) is searched. If there is not any code of the three solutions of a certain grayscale level, the grayscale level is converted to a neighboring grayscale level code having the above three coding manners and the coding manner is the display code, and the conversion manner is: the grayscale level=a neighboring grayscale level+a converted grayscale error. The display grayscale is output, and the converted grayscale error, if any, is diffused in the manner as shown in FIG. 5.

Figure 2:
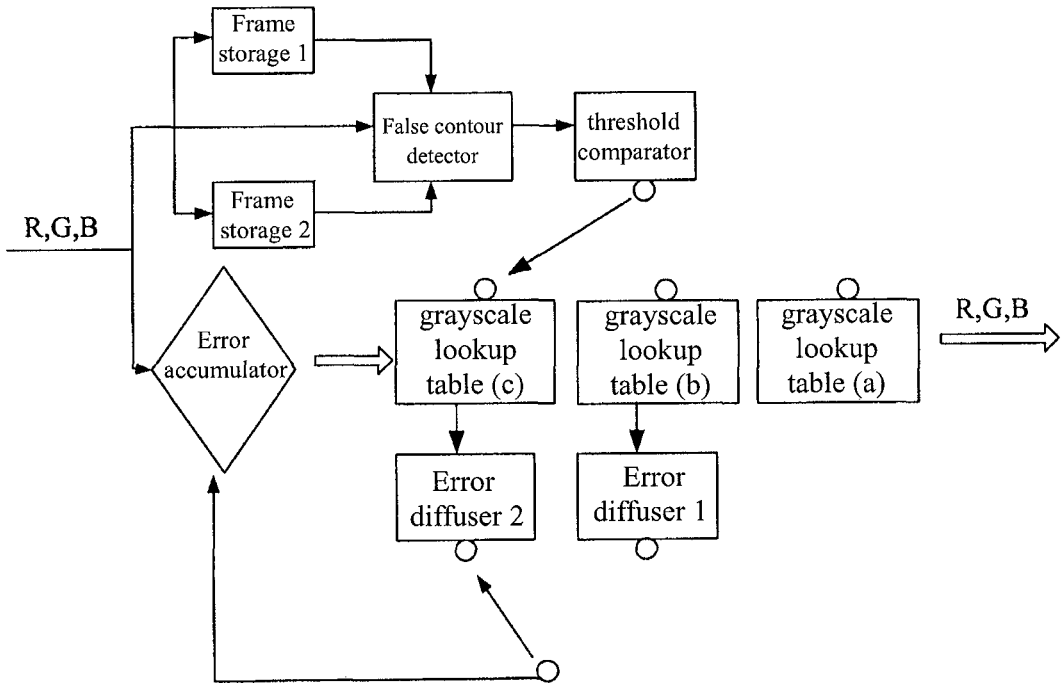
FIG. 2 illustrates the principle of the general realization of the system for reducing the dynamic false contour in the image of an alternating current plasma display according to an embodiment of the present invention.
Figure 3:
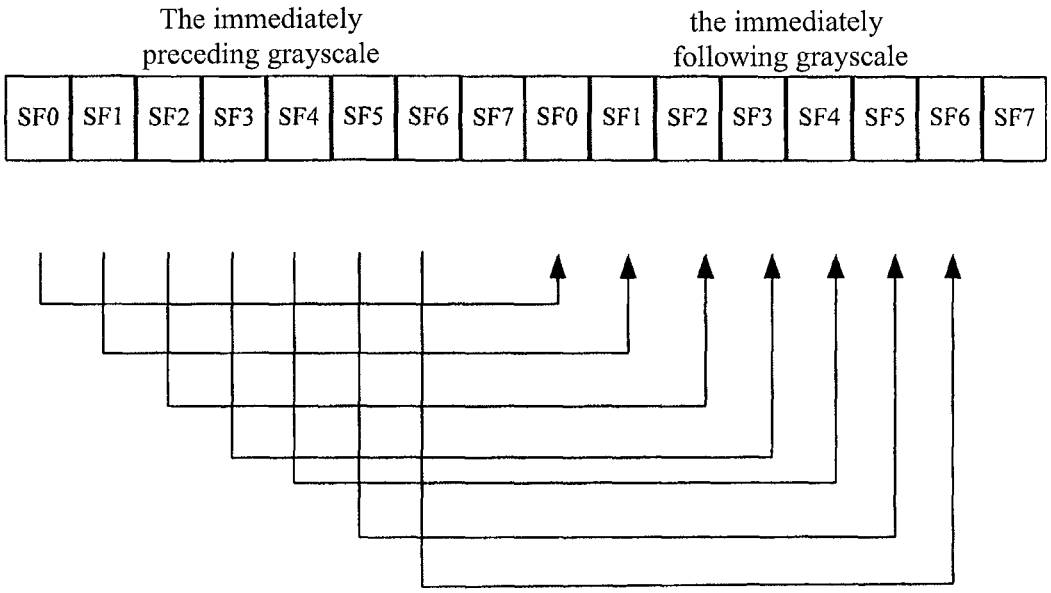
FIG. 3 is a schematic view of the grayscale integral of human eyes on a transiting grayscale.

The system for realizing the above method is shown in FIG. 2. Wherein, for inputted frame image data, on one hand, it and the immediately preceding frame image data should be calculated to detect the dynamic false contour, and on the other hand, it needs to be stored in a frame storage so as to be calculated together with the immediately following frame image. Hence, two frame storages are needed to conduct a ping-pong storage operation. First, after one field of image data is inputted, it is stored in frame storage 1, and inputted to a dynamic false contour detector at the same time. Meanwhile, the image data of the immediately preceding field is read from the other frame storage 2 and then inputted to the dynamic false contour detector. The detection and calculation principle of the dynamic false contour detector is to detect the dynamic false contour in the unit of the field image, and the detecting formula of the field image is:

$$D(\text{frame}) = \frac{1}{M \times N} \sum_{x=1}^{N} \sum_{y=1}^{M} (|Bi - Bj| * SP - |i - j|)(x, y), \tag{1}$$

Wherein, D(frame) is the final detection value of the field image, X and Y are the coordinates of the pixel positions in the field image, and i and j refer to the grayscale levels displayed by adjacent fields respectively. Wherein, i is the grayscale level displayed by a present field, and j represents the grayscale level displayed by the immediately preceding field. Wherein, SP refers to a determined subfield weight vector, Bi and Bj respectively refer to corresponding subfield code vectors of brightness levels i, j in the subfield vector SP. N is the number of rows of each frame image actually displayed in the alternating current plasma display, M is the number of subpixels actually displayed in each row in the alternating current plasma display, and the three base colors of R, G and B are independent of each other.

Which grayscale lookup table should be searched is determined by comparing a predetermined threshold with the D(frame). Three grayscale lookup tables of three optimized coding solutions are set according to an embodiment of the present invention. Wherein, the grayscale lookup tables are set as follows:

The grayscale lookup table (a) has the codes for grayscale levels from 0 to 255.

The grayscale lookup table (b) selects the grayscale levels of the following codes:

(1) If the maximum subfield with a grayscale data code of 1 is n, the grayscale data codes of the 1st subfield to the nth subfield are all set as 1. That is, all of the 1st digit to the nth digit of the grayscale data code of the certain frame image are 1.

(2) If the maximum subfield with a grayscale data code of 1 is n, the grayscale data codes of the subfields among the 1st subfield to the nth subfield are all set as 1 except for the subfields with a grayscale data code of 0. That is, all of the 1st digit to the nth digit of the grayscale data code of the certain frame image are 1 except for one digit being 0.

(3) If the maximum subfield of the grayscale data code is n, the grayscale data codes of the subfields among the 1st subfield to the nth subfield are all set as 1 except for two subfields with a grayscale data code of 0. That is, all of the 1st digit to the nth digit of the grayscale data code of the certain frame image are 1 except for two digits being 0.

Wherein, the subfields with the grayscale data code of 1 are subfields in a lighted state, and the subfields with the grayscale data code of 0 are subfields in an unlighted state.

Figure 4:
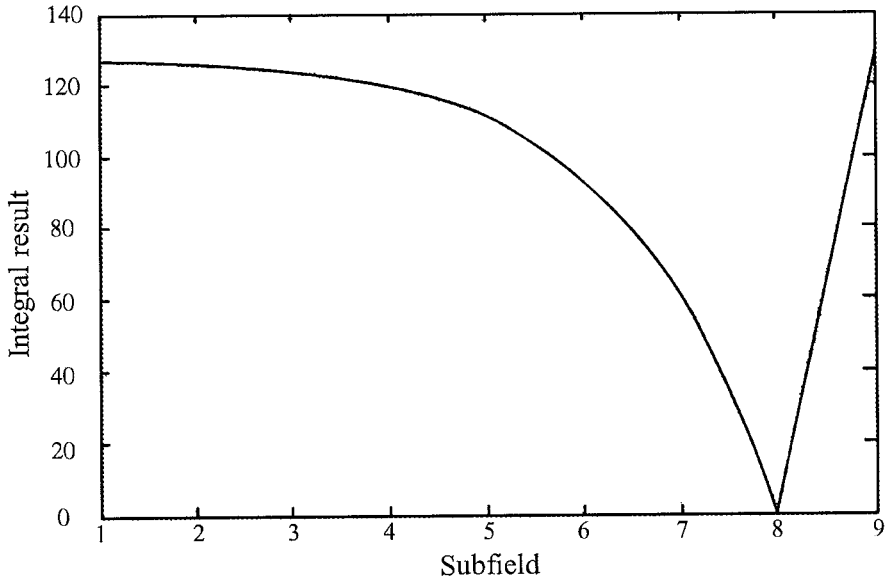
FIG. 4 illustrates the curve of change in the result of integral on the grayscale from 127 to 128 by human eyes.

The principle for selecting the code of a grayscale level is described as follows: with a determined subfield weight arrangement, a certain grayscale level has multiple coding manners, and a grayscale data code conforming to the coding manner of (1) is selected first. If there is not, a grayscale data code conforming to the coding manner of (2) is selected, or a grayscale data code conforming to the coding manner of (3) is selected. If there is none of the three, the grayscale level is converted to a neighboring grayscale level having the above three coding manners. The conversion manner is: the grayscale level=a neighboring grayscale level+a converted grayscale error. For example, in the case of a subfield weight arrangement of (1, 2, 4, 8, 14, 22, 30, 35, 39, 46, 54), the grayscale level 126 does not have the grayscale data code in the above coding manners, while its neighboring grayscale level 125 has the above coding manner 00110111111 (the subfield weights are from high to low), then the grayscale level 126 is converted to 126=125+1, that is to say, the grayscale data code of the grayscale level 126 is converted to that of 125, plus the converted grayscale error. The manner of making the grayscale lookup table (b) is that any grayscale level is code+converted grayscale error. The converted grayscale error of the grayscale level having the above coding manners is 0. Hence, in the grayscale lookup table (b), the coding manners of 125 and 126 are 0011011111101 and 0011011111100. The two lowest digits are the converted error, i.e., the grayscale code error of 126 is 01, and the grayscale code error of 125 is 00. For example, FIG. 4 illustrates the curve of change in the result of integral on the grayscale from 127 to 128 by human eyes.

The grayscale lookup table (c) selects the grayscale levels of the following codes:

(1) If the maximum subfield with a grayscale data code of 1 is n, the grayscale data codes of the 1st subfield to the nth subfield are all set as 1. That is, all of the 1st digit to the nth digit of the grayscale data code of a certain frame image are 1.

(2) If the maximum subfield with a grayscale data code of 1 is n, the grayscale data codes of the subfields among the 1st subfield to the nth subfield are all set as 1 except for the subfields with a grayscale data code of 0. That is, all of the 1st digit to the nth digit of the grayscale data code of the certain frame image are 1 except for one digit being 0.

Wherein, the subfields with the grayscale data code of 1 are subfields in a lighted state, and the subfields with the grayscale data code of 0 are subfields in an unlighted state.

As can be seen from the above selecting principle, grayscale lookup table (c) is in essence a subset of grayscale lookup table (b). Hence, they are similar in coding and table establishment. However, as the converted grayscale error may increase, the coding width of the converted grayscale error may increase to four bits correspondingly.

The selection of the lookup table is determined according to the value of the D(frame). The selecting principle is as follows: if D(frame)=<7, the grayscale lookup table (a) is searched; if 7<D(frame)=<20, the grayscale lookup table (b) is searched; and if D(frame)>20, the grayscale lookup table (c) is searched.

If the alternating current plasma display displays a static image, as known from the principle of calculation, if the D(frame) is not more than 7, the probability that the human eyes perceive the false contour phenomenon of the whole screen of image is small, or the perception of false contour phenomenon is too slight to be recognized, the grayscale lookup table (a) is searched; if the value of the D(frame) is within the range of 7 to 20, the human eyes can clearly perceive the dynamic false contour phenomenon, then the grayscale lookup table (b) is searched; if the value of the D(frame) is more than 20, the human eyes perceive a very distinct dynamic false contour phenomenon, then the grayscale lookup table (c) is searched. The threshold comparator in FIG. 2 is used in the above judgment to determine which grayscale lookup table should be searched for each field of image.

Figure 6:
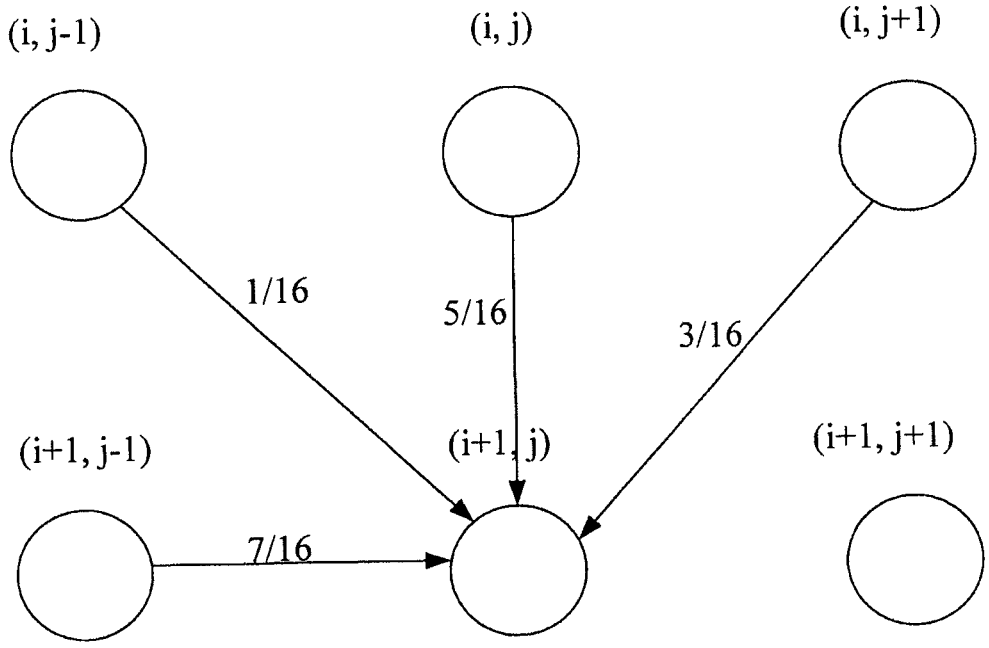
FIG. 6 is a schematic view of the error accumulation according to an embodiment of the present invention.

As the grayscale lookup tables (b) and (c) have error in the conversion of grayscale, to avoid loss of the pixel grayscale, the converted grayscale error is diffused to adjacent pixel points by an error diffuser. The diffusing principle is shown in FIG. 5, and the diffusing coefficients are 1/16, 3/16, 5/16 and 7/16 respectively. That is, each pixel point is accumulated with the errors diffused from the pixel points at the left upper corner with ratios of 1/16, 3/16, 5/16 and 7/16, and its own converted grayscale error is diffused to the pixel points at the right lower corner with ratios of 1/16, 3/16, 5/16 and 7/16. The grayscale lookup table (a) has accurate codes of grayscale levels from 0 to 255 and does not have error in the conversion of grayscale, and thus the error diffuser is not needed. As known from FIG. 1, the image grayscale data should be first have an error accumulating before the grayscale searching, and the principle of the error accumulation can be seen from FIG. 6.

The description above is only preferable embodiments of the present invention, which is not used to restrict the present invention. For those skilled in the art, the present invention may have various changes and variations. Any modifications, equivalent substitutions, improvements etc. within the spirit and principle of the present invention shall all be included in the scope of protection of the present invention.

The invention claimed is:

1. A method for reducing the dynamic false contour in the image of an alternating current plasma display, characterized by, comprising the following steps:

dividing each frame image into multiple subfields;

accounting the number and the probability of the dynamic false contour appeared in each frame image; and based on the result of the accounting, carrying out an optimized coding for the pixel data of each frame image, and if there is an error generated by the optimized coding, diffusing the error generated by the optimized coding into neighboring pixels.

2. The method according to claim 1, characterized in that the optimized coding is carried out for the pixel data of each frame image by the following pixel data optimized coding method: if the maximum subfield with a grayscale data code of 1 is n, the grayscale data codes of the 1st subfield to the nth subfield are all set as 1.

3. The method according to claim 1, characterized in that optimized coding is carried out for the pixel data of each frame image by the following pixel data optimized coding method: if the maximum subfield with a grayscale data code of 1 is n, the grayscale data codes of the subfields among the 1st subfield to the nth subfield are all set as 1 except for the subfields with a grayscale data code of 0.

4. The method according to claim 1, characterized in that optimized coding is carried out for the pixel data of each frame image by the following pixel data optimized coding method: if the maximum subfield with a grayscale data code of 0 or 1 is n, the grayscale data codes of the subfields among the 1st subfield to the nth subfield are all set as 1 except for the subfields with a grayscale data code of 0.

5. The method according to any of claims 2 to 4, characterized in that the subfields with the grayscale data code of 1 are subfields in a lighted state, and the subfields with the grayscale data code of 0 are subfields in an unlighted state.

6. The method according to claim 5, characterized in that if each frame image does not have a grayscale data code that conforms to a corresponding optimized coding rule, the grayscale level of each frame image is converted in the following manner: the grayscale level= an neighboring grayscale level+ a converted grayscale error, and the converted grayscale error is diffused into neighboring pixels.

* * * * *